US010907910B2

(12) United States Patent
Kao et al.

(10) Patent No.: US 10,907,910 B2
(45) Date of Patent: Feb. 2, 2021

(54) VAPOR-LIQUID PHASE FLUID HEAT TRANSFER MODULE

(71) Applicant: ASIA VITAL COMPONENTS CO., LTD., New Taipei (TW)

(72) Inventors: Pai-Liang Kao, New Taipei (TW); Dan-Jun Chen, New Taipei (TW); Guo-Hui Li, New Taipei (TW)

(73) Assignee: Asia Vital Components CO., LTD

( * ) Notice: Subject to any disclaimer, the term of this patent is extended or adjusted under 35 U.S.C. 154(b) by 156 days.

(21) Appl. No.: 15/874,891

(22) Filed: Jan. 19, 2018

(65) Prior Publication Data

US 2019/0226769 A1 Jul. 25, 2019

(51) Int. Cl.
*F28D 15/04* (2006.01)
*F28D 1/02* (2006.01)
*F28D 21/00* (2006.01)

(52) U.S. Cl.
CPC ..... *F28D 15/043* (2013.01); *F28D 1/0226* (2013.01); *F28D 2021/0029* (2013.01)

(58) Field of Classification Search
CPC .. F28D 15/043; F28D 15/0275; F28D 1/0226; F28D 2021/0029
See application file for complete search history.

(56) References Cited

U.S. PATENT DOCUMENTS 6,776,221 B2 * 8/2004 Montgomery ..... F28D 15/043 165/104.14
7,957,132 B2 * 6/2011 Fried ..... F28D 15/0266 361/679.47
2003/0051860 A1 * 3/2003 Montgomery ..... F28D 15/043 165/46
2006/0254753 A1 * 11/2006 Phillips ..... F28D 15/025 165/100
2011/0000647 A1 * 1/2011 Hou ..... F28D 15/043 165/104.26
2011/0198057 A1 * 8/2011 Lange ..... F28D 15/0233 165/104.26
2014/0360556 A1 * 12/2014 Koppikar ..... H02S 40/44 136/248
2016/0116226 A1 * 4/2016 Dupont ..... B60H 1/00492 165/104.21
2016/0209894 A1 * 7/2016 Hsieh ..... F28D 15/0233
2017/0303432 A1 * 10/2017 Matsunaga ..... F25B 41/00

* cited by examiner

*Primary Examiner* — Jon T. Schermerhorn, Jr.
(74) *Attorney, Agent, or Firm* — Demian K. Jackson; Jackson IPG PLLC

(57) ABSTRACT

A vapor-liquid phase fluid heat transfer module includes: at least one evaporator having a first chamber inside, which containing a first working medium; at least one evaporator tube body having a first end, a second end and a condensation section positioned, the first and second ends communicating with the first chamber of the at least one evaporator to form a loop of the first working medium; at least one heat exchanger having a heat exchange chamber, a first face and a second face for the condensation section of the evaporator tube body to attach to; and at least one heat sink tube body, which communicating with the heat exchange chamber of the at least one heat exchanger and the at least one heat sink to form a loop of the second working medium.

13 Claims, 11 Drawing Sheets

VAPOR-LIQUID PHASE FLUID HEAT TRANSFER MODULE

BACKGROUND OF THE INVENTION

1. Field of the Invention

The present invention relates generally to a heat dissipation field, and more particularly to a vapor-liquid phase fluid heat transfer module, in which the heat exchange area is minified and the heat transfer path is shortened to enhance the heat exchange efficiency.

2. Description of the Related Art

It is known that a fan and radiating fins are often used to dissipate heat. However, the performance of the current electronic apparatuses has become higher and higher so that the electronic components in the electronic apparatuses for processing signals and operation will generate more heat than the traditional electronic components. Therefore, vapor-liquid phase fluid heat transfer technique has been applied to those products or environments with high heat flux to dissipate the heat. According to the theory of phase change, the heat flux can reach over 50 $W/cm^2$ without extra electrical power. Therefore, the vapor-liquid phase fluid heat transfer technique has the advantages of heat transfer and energy saving.

The current vapor-liquid phase fluid heat transfer techniques include loop heat pipe (LHP), capillary porous loop (CPL), two-phase loop thermosyphon (LTS), etc. The device of the vapor-liquid phase fluid heat transfer technique generally includes an evaporator and a heat sink connected with each other via a tube body to form a closed loop. Through the tube body, the heat is transferred from the evaporator to the remote end heat sink so as to dissipate the heat.

However, the heat sink of the current vapor-liquid phase fluid heat transfer technique is cooled by a fan. The fan for cooling the heat sink necessitates a larger heat exchange area so that a larger internal space of the system will be occupied. Also, the heat transfer path of the conventional tube body is longer so that the working medium in the tube body can hardly quickly flow back. This leads to poor heat exchange efficiency.

It is therefore tried by the applicant to provide a vapor-liquid phase fluid heat transfer module, which can fully utilize the internal space of the system to satisfy the heat exchange requirement of the heat sink and surpasses the heat exchange efficiency of the fan.

SUMMARY OF THE INVENTION

It is therefore a primary object of the present invention to provide a vapor-liquid phase fluid heat transfer module, in which the heat exchange area is minified and the heat transfer path of the vapor tube and the condensation tube is shortened.

It is a further object of the present invention to provide the above vapor-liquid phase fluid heat transfer module, which can enhance the heat exchange efficiency.

To achieve the above and other objects, the vapor-liquid phase fluid heat transfer module of the present invention includes: at least one evaporator having a first chamber inside, a first working medium being filled in the first chamber; at least one evaporator tube body having a first end, a second end and a condensation section positioned between the first and second ends, the first and second ends communicating with the first chamber of the at least one evaporator to form a loop of the first working medium; at least one heat exchanger having a heat exchange chamber inside, the at least one heat exchanger further having a first face and a second face for the condensation section of the evaporator tube body to attach to; and at least one heat sink tube body. The heat sink tube body communicates with the heat exchange chamber of the at least one heat exchanger and at least one heat sink. The heat sink tube body serves as a loop of a second working medium for the second working fluid to flow through.

According to the design of the present invention, a heat exchanger is disposed on the condensation section of the evaporator tube body or multiple heat exchangers are stacked and assembled. In addition, through the heat sink tube body, the heat is quickly transferred to the heat sink to dissipate the heat. In this case, the heat exchange area is minified and the heat transfer path is shortened to enhance the heat exchange efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
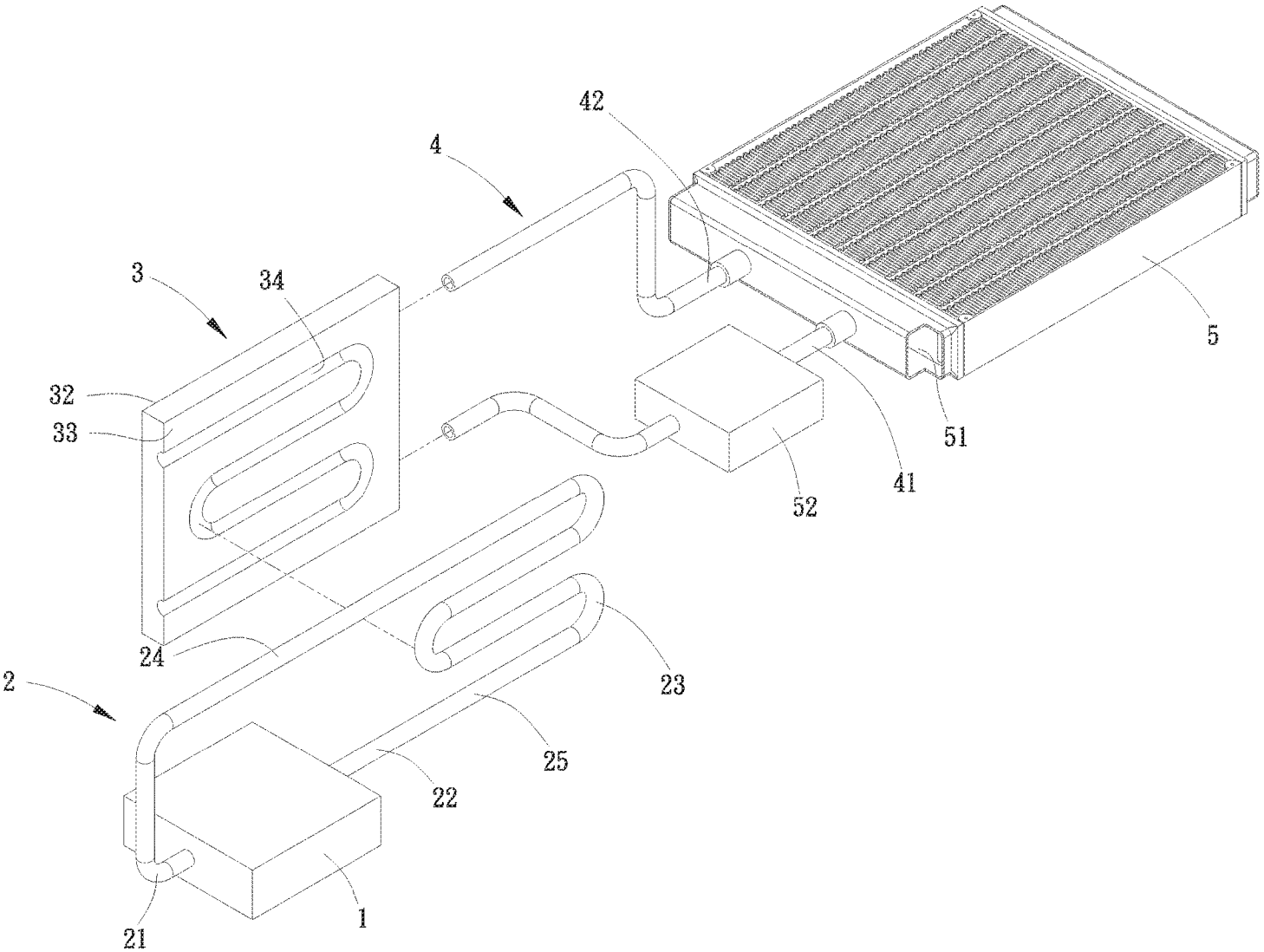
FIG. 1A is a perspective exploded view of a first embodiment of the vapor-liquid phase fluid heat transfer module of the present invention.
Figure 1B:
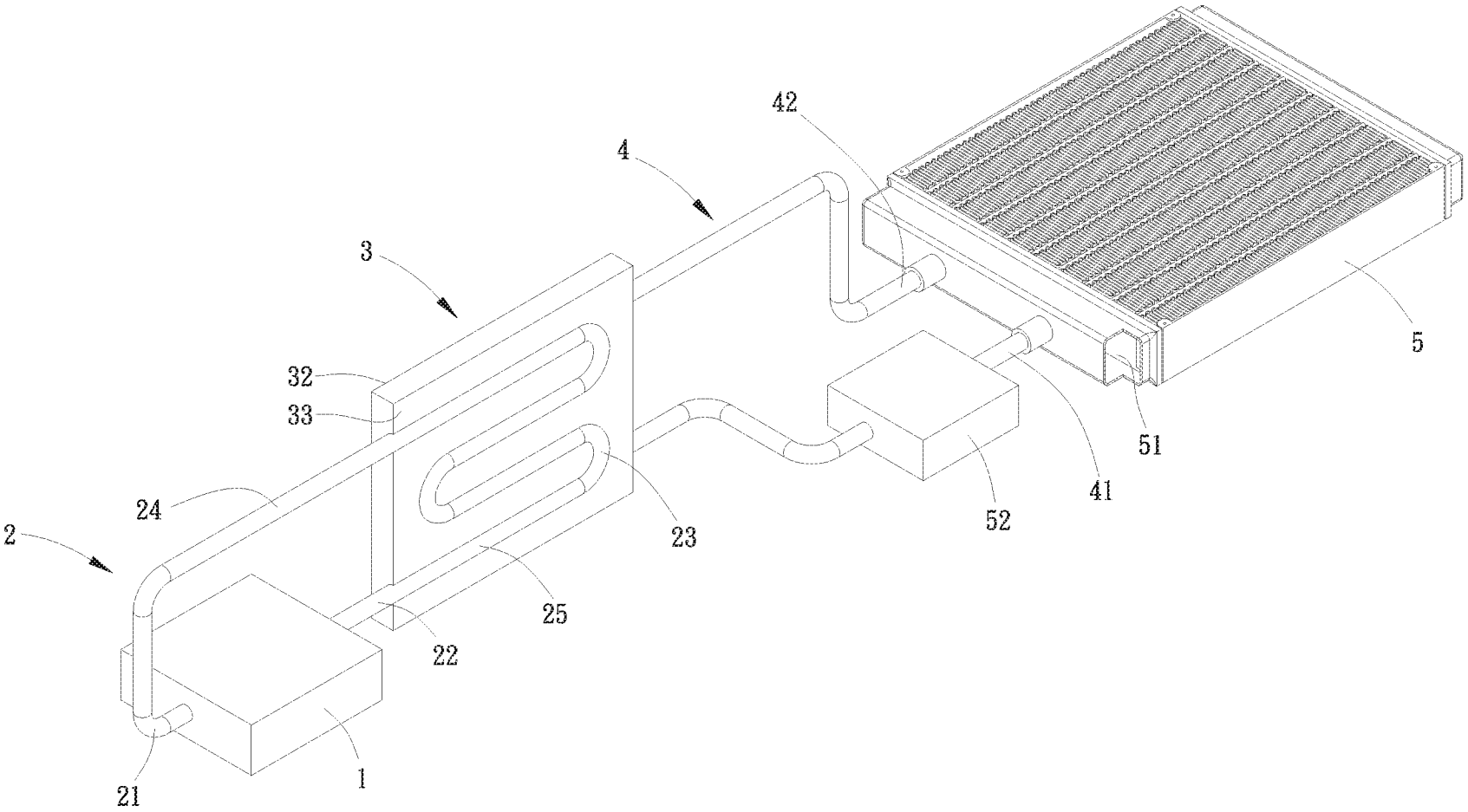
FIG. 1B is a perspective assembled view of the first embodiment of the to vapor-liquid phase fluid heat transfer module of the present invention.
Figure 1C:
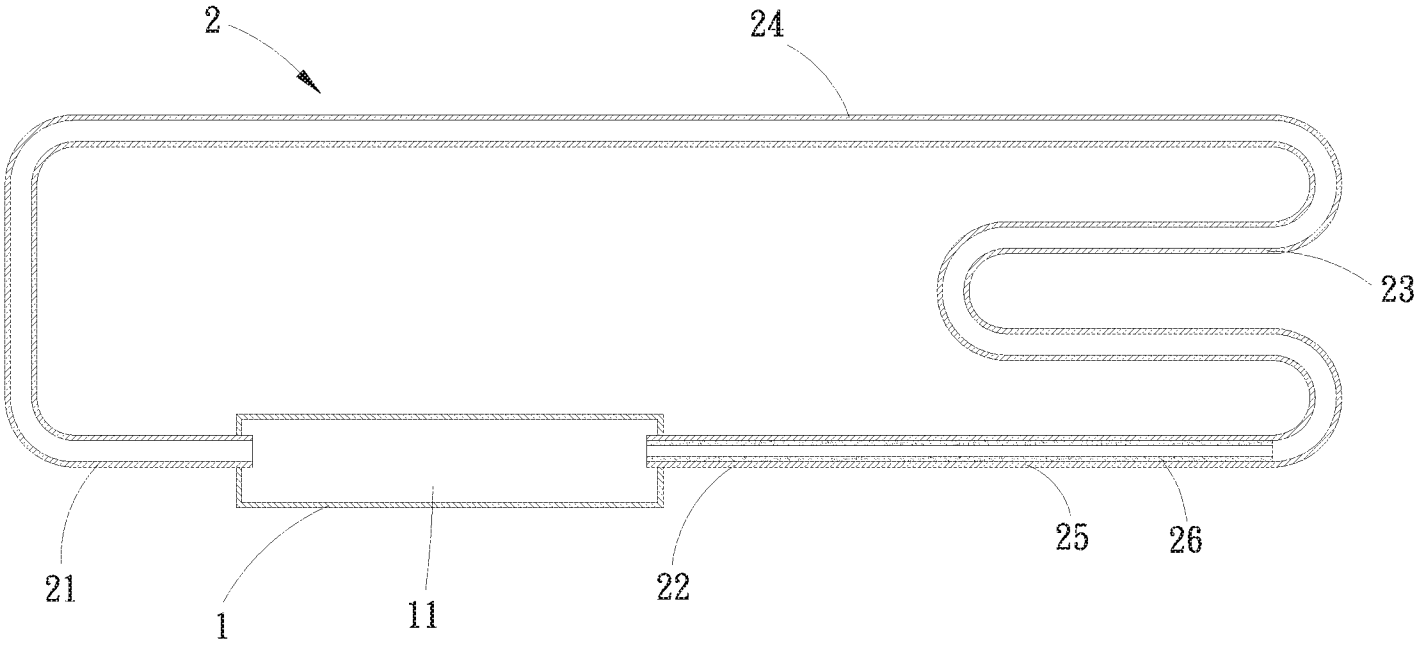
FIG. 1C is a sectional view of the evaporator and the evaporator tube body of the first embodiment of the vapor-liquid phase fluid heat transfer module of the present invention.
Figure 1D:
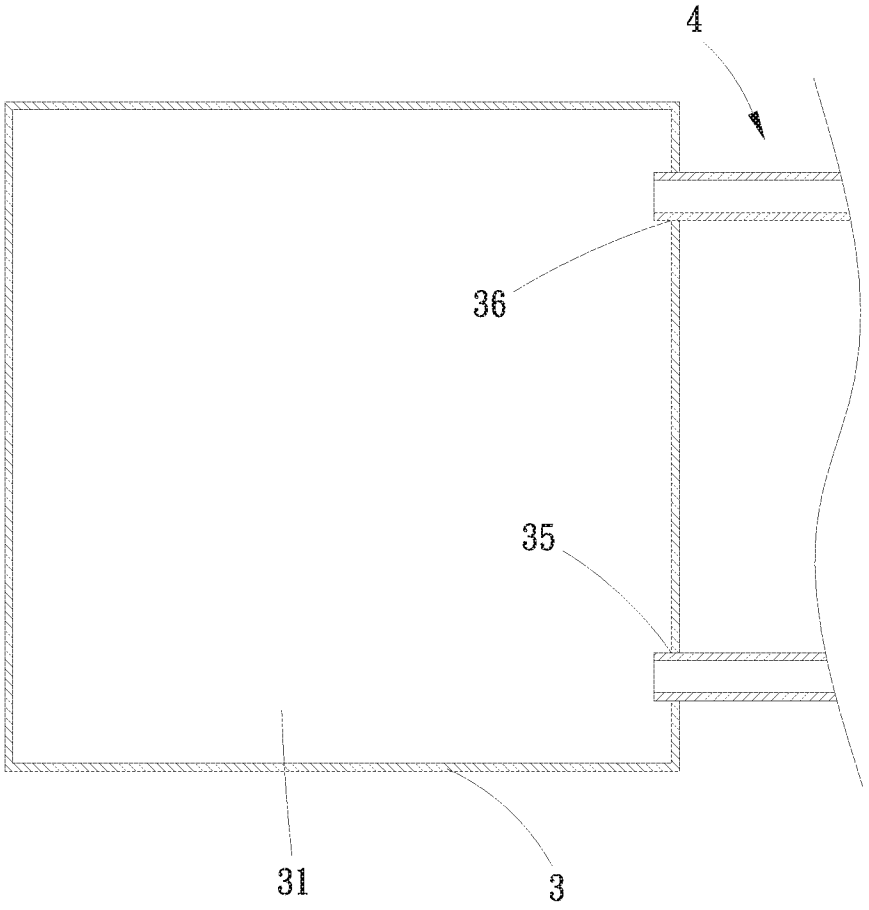
FIG. 1D is a sectional view of the heat exchanger and the heat sink tube body of the first embodiment of the vapor-liquid phase fluid heat transfer module of the present invention.

Please refer to FIGS. 1A, 1B, 1C and 1D. FIG. 1A is a perspective exploded view of a first embodiment of the vapor-liquid phase fluid heat transfer module of the present invention. FIG. 1B is a perspective assembled view of the first embodiment of the vapor-liquid phase fluid heat transfer module of the present invention. FIG. 1C is a sectional view of the evaporator and the evaporator tube body of the first embodiment of the vapor-liquid phase fluid heat transfer module of the present invention. FIG. 1D is a sectional view of the heat exchanger and the heat sink tube body of the first embodiment of the vapor-liquid phase fluid heat transfer module of the present invention. According to the first embodiment, the vapor-liquid phase fluid heat transfer module of the present invention includes at least one evaporator, at least one evaporator tube body, at least one heat exchanger, at least one heat exchanger tube body and at least one heat sink. In this embodiment, there are, but not limited to, one evaporator 1, one evaporator tube body 2, one heat exchanger 3, one heat exchanger tube body 4 and one heat sink 5. In practice, some modifications of this embodiment can be made to achieve the same effect.

The evaporator 1 has a first chamber 11 inside. A first working medium is contained in the first chamber 11. The first working medium is a liquid with high specific heat coefficient. The evaporator 1 is attached to a heat source (not shown) to absorb heat from the heat source. In this embodiment, the evaporator 1 is, but not limited to, a rectangular plate body. In a modified embodiment, the evaporator 1 can be alternatively a tubular evaporator with a diameter larger than that of the evaporator tube body 2. The shape or configuration of the evaporator 1 of the present invention is not limited.

The evaporator tube body 2 has a first end 21, a second end 22 and a condensation section 23. The first and second ends 21, 22 are respectively positioned at two opposite ends of the evaporator tube body 2. The first and second ends 21, 22 communicate with the first chamber 11 to form a loop of the first working medium. The condensation section 23 is positioned between the first and second ends 21, 22. The evaporator tube body 2 further has a vapor section 24 and a liquid section 25. The vapor section 24 is adjacent to the first end 21. The liquid section 25 is adjacent to the second end 22. The condensation section 23 is connected between the vapor section 24 and the liquid section 25. In this embodiment, a capillary structure 26 is, but not limited to, disposed in the liquid section 25. In a modified embodiment, the interior of the liquid section 25 can be alternatively free from the capillary structure 26. In this embodiment, the evaporator tube body 2 is, but not limited to, a circular tube. In a modified embodiment, the evaporator tube body 2 can be alternatively a flat tube.

The heat exchanger 3 has a heat exchange chamber 31, a first face 32, a second face 33, a water inlet 35 and a water outlet 36. The first and second faces 32, 33 are respectively disposed on two opposite faces of the heat exchanger 3 for the condensation section 23 of the evaporator tube body 2 to attach to. The condensation section 23 of the evaporator tube body 2 is selectively attached to the first face 32 or the second face 33. In this embodiment, the condensation section 23 of the evaporator tube body 2 is, but not limited to, attached to the second face 33 of the heat exchanger 3. Alternatively, the condensation section 23 of the evaporator tube body 2 can be attached to the first face 32.

The heat sink tube body 4 has a third end 41 and a fourth end 42. The third and fourth ends 41, 42 are respectively disposed at two opposite ends of the heat sink tube body 4. The heat sink tube body 4 communicates with the heat exchange chamber 31 of the heat exchanger 3 and the heat sink 5. The heat sink tube body 4 serves as a loop of a second working medium for the second working fluid to flow through. The second working medium is a liquid with high specific heat coefficient. In this embodiment, the heat sink tube body 4 is, but not limited to, a circular tube. In a modified embodiment, the heat sink tube body 4 can be alternatively a flat tube.

The heat sink 5 has a second chamber 51 and a pump 52. The heat sink tube body 4 communicates with the heat exchange chamber 31 of the heat exchanger 3 through the water inlet 35 and water outlet 36 of the heat exchanger 3. In addition, the heat sink tube body 4 communicates with the second chamber 51 and the pump 52 of the heat sink 5 through the third and fourth ends 41, 42 to form the loop of the second working medium. In this embodiment, the heat sink 5 is a water-cooling radiator as shown in FIGS. 1A and 1B in a partially sectional state. In this embodiment, the heat sink tube body 4 is a water-cooling tube. The pump 52 is, but not limited to, disposed in adjacency to the third end 41 of the heat sink tube body 4. In a modified embodiment, the pump 52 can be alternatively disposed in adjacency to the fourth end 42 of the heat sink tube body 4.

In this embodiment, the heat exchanger 3 has at least one recess 34 corresponding to the evaporator tube body 2. The condensation section 23 of the evaporator tube body 2 is, but not limited to, inlaid in the at least one recess 34. In a modified embodiment, the heat exchanger 3 has a plane surface and the condensation section 23 of the evaporator tube body 2 is attached to the plane surface of the heat exchanger 3. In another modified embodiment, the condensation section 23 of the evaporator tube body 2 is inlaid in the recess 34 of the heat exchanger 3 in flush with the outer surface of the heat exchanger 3. In this embodiment, the heat exchanger 3 is a water-cooling head.

In a preferred embodiment, the first working medium in the first chamber 11 is heated to the boiling point and evaporated into a vapor-phase first working medium. The vapor-phase first working medium passes through the first end 21 into the vapor section 24. Then the vapor-phase first working medium flows through the vapor section 24 to the condensation section 23. The condensation section 23 absorbs the heat of the vapor-phase first working medium and heat-exchanges with the heat exchanger 3. The vapor-phase first working medium in the condensation section 23 is condensed into a liquid-phase first working medium. The liquid-phase first working medium is absorbed by the capillary structure 26 of the liquid section 25 to flow through the second end 22 back into the first chamber 11 of the evaporator 1. In a modified embodiment, the liquid section 23 is free from the capillary structure 26 and the liquid-phase first working medium is pushed by gas pressure to flow through the second end 22 back into the first chamber 11 of the evaporator 1.

The heat exchanger 3 absorbs the heat of the condensation section 23 of the evaporator tube body 2. The second working medium is driven by the pump 52 to flow from the second chamber 51 of the heat sink 5 through the third end 41 of the heat exchanger tube body 4 and flow from the water inlet 35 into the heat exchange chamber 31. The second working fluid absorbs the heat of the heat exchanger 3 and flows from the water outlet 36 through the fourth end 42 back into the second chamber 51. The heat sink 5 absorbs the heat of the second working medium to dissipate the heat by way of radiation.

According to the design of the present invention, the heat of the evaporator 1 is collectively transferred to the heat exchanger 3. Then the heat of the heat exchanger 3 is transferred through the heat sink tube body 4 to the heat sink 5 to dissipate the heat. Therefore, the heat exchange area can be minified. Also, the heat transfer path can be shortened, whereby the first and second working media can quickly flow back to enhance the heat exchange efficiency.

Figure 2A:
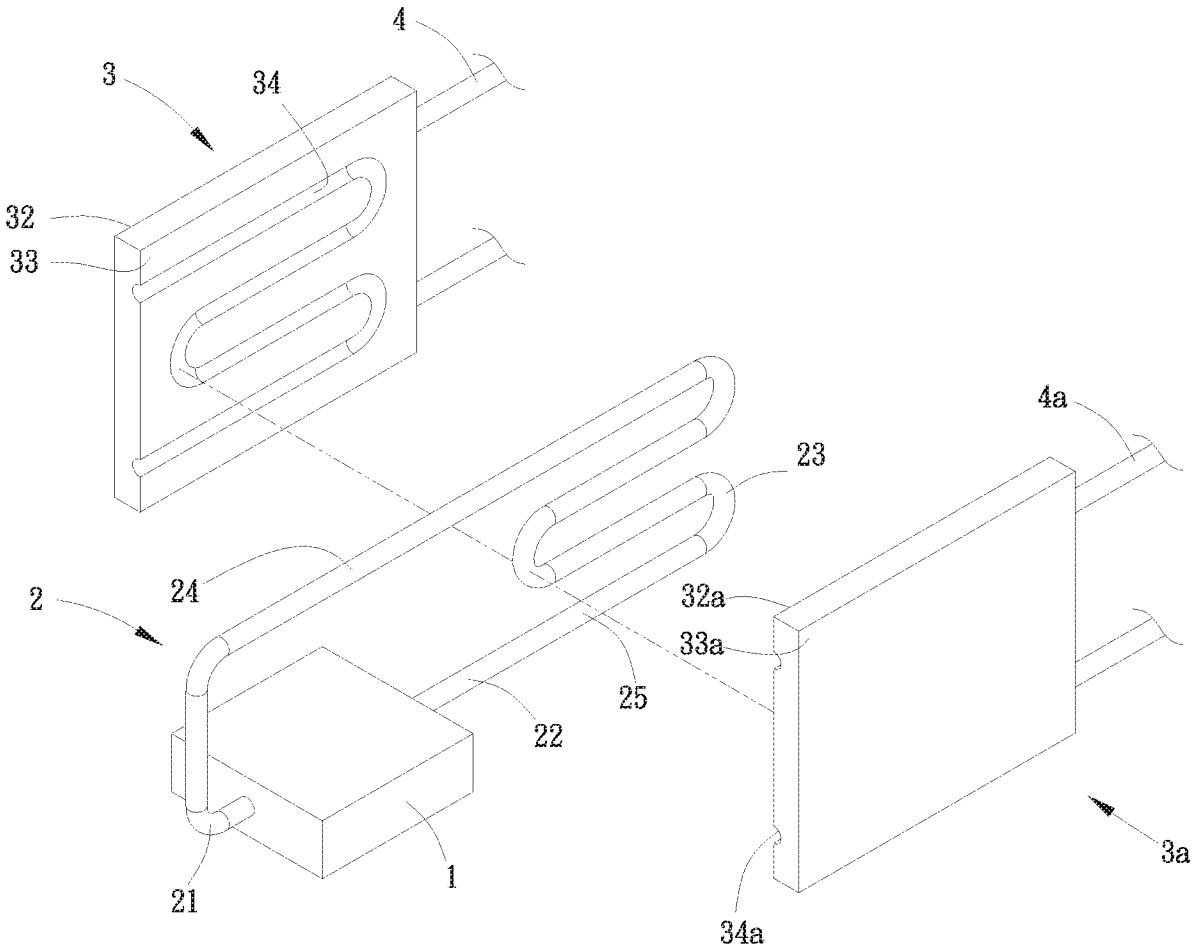
FIG. 2A is a perspective exploded view of a second embodiment of the vapor-liquid phase fluid heat transfer module of the present invention.
Figure 2B:
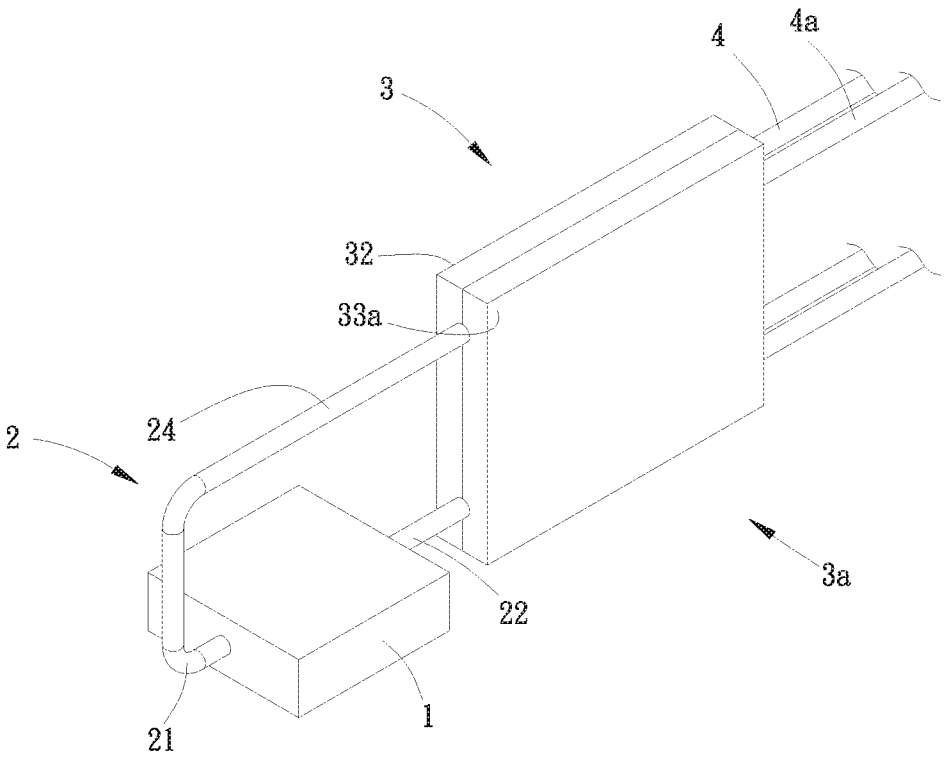
FIG. 2B is a perspective assembled view of the second embodiment of the vapor-liquid phase fluid heat transfer module of the present invention.

Please now refer to FIGS. 2A and 2B. FIG. 2A is a perspective exploded view of a second embodiment of the vapor-liquid phase fluid heat transfer module of the present invention. FIG. 2B is a perspective assembled view of the second embodiment of the vapor-liquid phase fluid heat transfer module of the present invention. Also referring to FIGS. 1A, 1B, 1C and 1D, the second embodiment is partially identical to the first embodiment in structure and function and thus will not be redundantly described hereinafter. The second embodiment is different from the first embodiment in that the at least one heat exchanger includes a first heat exchanger 3 and a second heat exchanger 3*a*. The at least one heat sink tube body includes a first heat sink tube body 4 and a second heat sink tube body 4*a*. The at least one heat sink includes a first heat sink 5 and a second heat sink (not shown). The first heat sink tube body 4 communicates with the first heat sink 5. The second heat sink tube body 4*a* communicates with the second heat sink. The structure and assembling relationship of the second heat sink tube body 4*a* and the second heat sink are identical to the structure and assembling relationship of the heat sink tube body 4 and the heat sink 5 as shown in FIG. 1B.

In this embodiment, the condensation section 23 of the first evaporator tube body 2 is, but not limited to, attached to the second face 33 of the first heat exchanger 3 and the first face 32*a* of the second heat exchanger 3*a*. Alternatively, the condensation section 23 of the first evaporator tube body 2 can be attached to the first face 32 of the first heat exchanger 3 and the second face 33*a* of the second heat exchanger 3*a*. Still alternatively, the condensation section 23 of the first evaporator tube body 2 can be attached to the first face 32 of the first heat exchanger 3 and the first face 32*a* of the second heat exchanger 3*a*. Still alternatively, the condensation section 23 of the first evaporator tube body 2 can be attached to the second face 33 of the first heat exchanger 3 and the second face 33*a* of the second heat exchanger 3*a*.

The condensation section 23 of the first evaporator tube body 2 is inlaid in the recess 34 of the first heat exchanger 3 and the recess 34*a* of the second heat exchanger. Accordingly, the second face 33 of the first heat exchanger 3 and the first face 32*a* of the second heat exchanger 3*a* are correspondingly attached to each other.

According to the above arrangement, the condensation section 23 of the first evaporator tube body 2 can heat-exchange with the first and second heat exchangers 3, 3*a* at the same time. The first and second heat exchangers 3, 3*a* absorb the heat of the condensation section 23. The second working medium flows through the first and second heat sink tube bodies 4, 4*a* to carry away the heat and flow back to the first and second heat sinks. Therefore, the heat exchange area is minified and the heat transfer path is shortened to enhance the heat exchange efficiency.

Figure 3A:
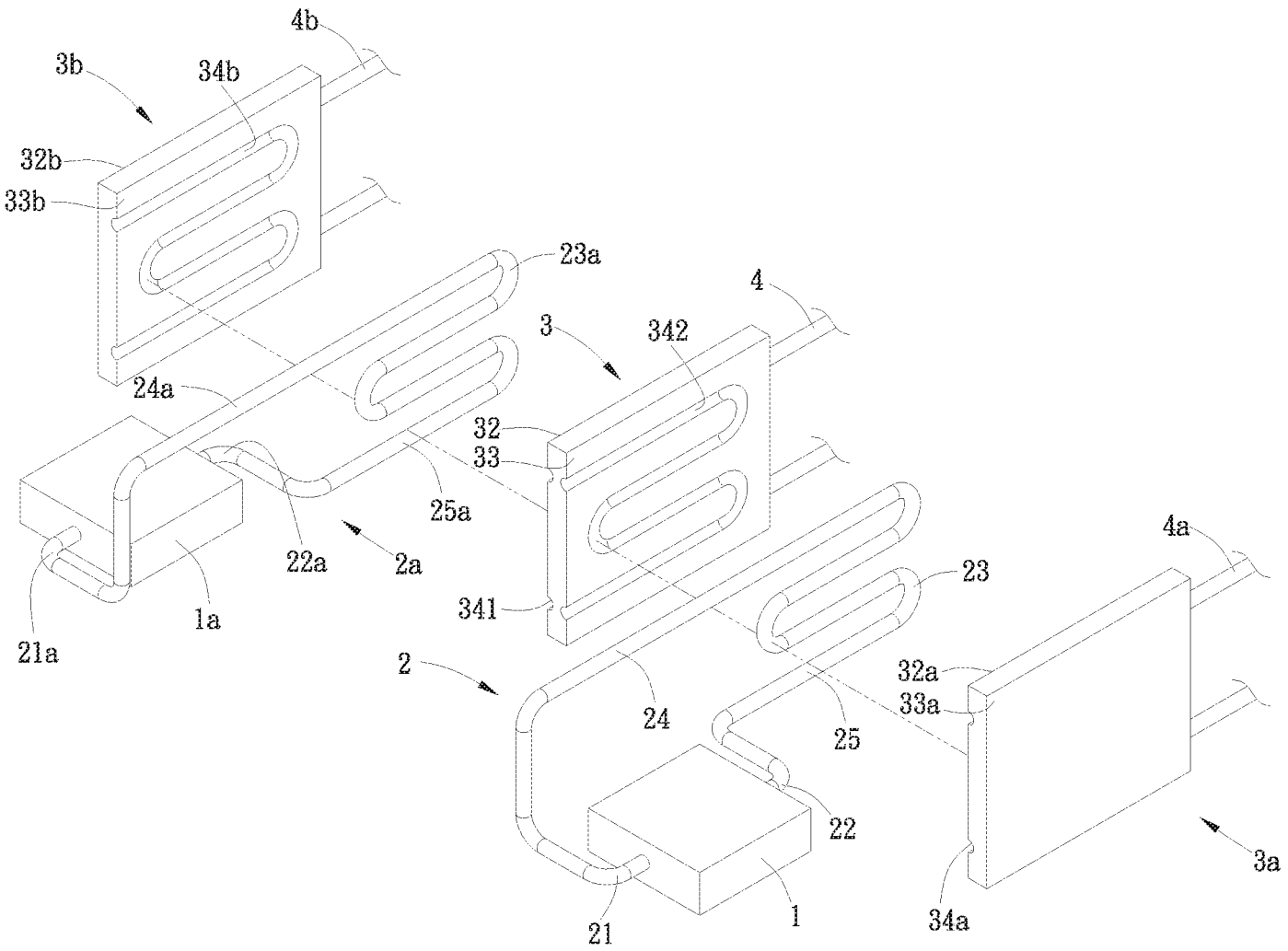
FIG. 3A is a perspective exploded view of a third embodiment of the vapor-liquid phase fluid heat transfer module of the present invention.
Figure 3B:
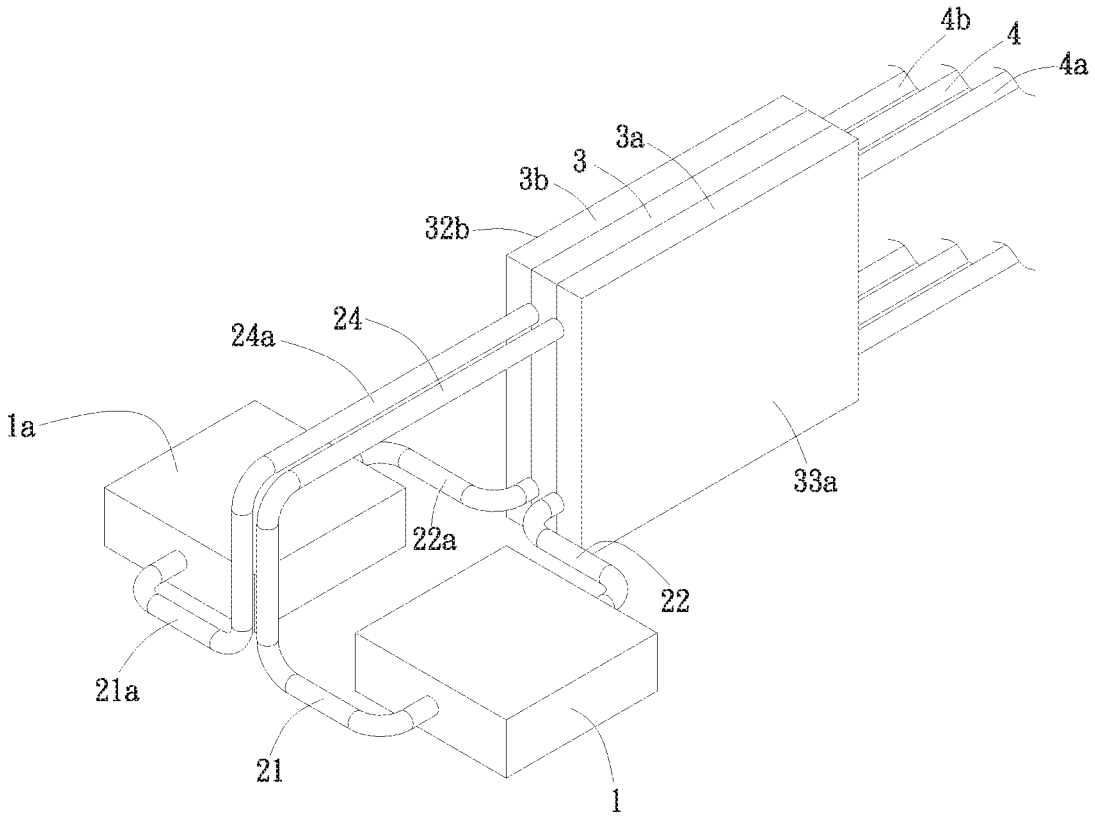
FIG. 3B is a perspective assembled view of the third embodiment of the vapor-liquid phase fluid heat transfer module of the present invention.
Figure 3C:
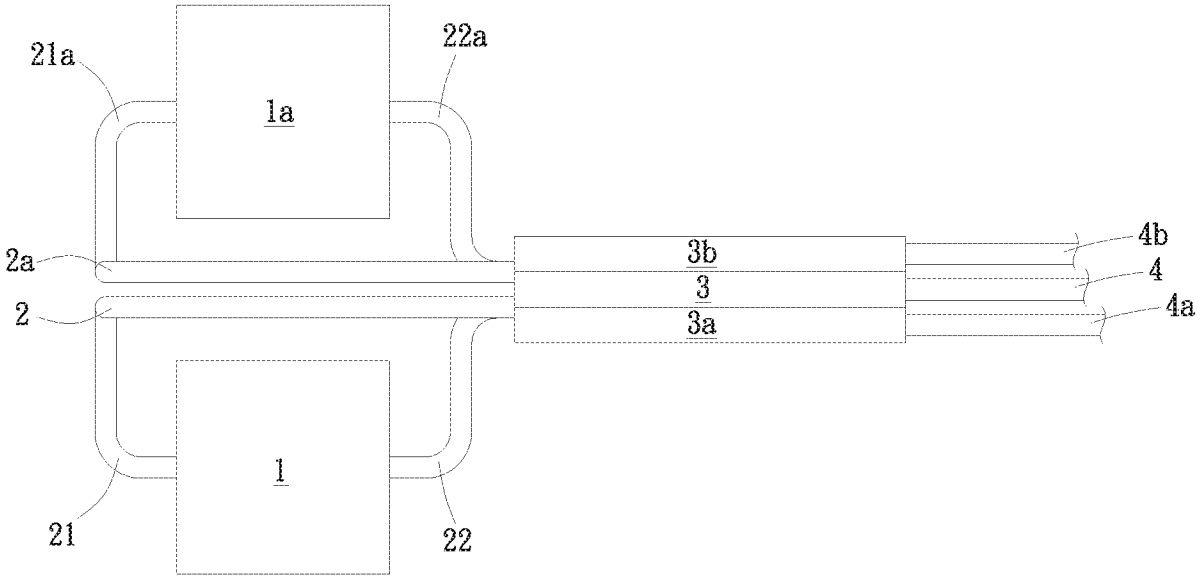
FIG. 3C is a top view of the third embodiment of the vapor-liquid phase fluid heat transfer module of the present invention.

Please now refer to FIGS. 3A, 3B and 3C. FIG. 3A is a perspective exploded view of a third embodiment of the vapor-liquid phase fluid heat transfer module of the present invention. FIG. 3B is a perspective assembled view of the third embodiment of the vapor-liquid phase fluid heat transfer module of the present invention. FIG. 3C is a top view of the third embodiment of the vapor-liquid phase fluid heat transfer module of the present invention. Also referring to FIGS. 2A and 2B, the third embodiment is partially identical to the second embodiment in structure and function and thus will not be redundantly described hereinafter. The third embodiment is different from the second embodiment in that the at least one evaporator includes a first evaporator 1 and a second evaporator 1*a*. The at least one evaporator tube body includes a first evaporator tube body 2 and a second evaporator tube body 2*a*. The at least one heat exchanger further includes a third heat exchanger 3*b*. The at least one heat sink tube body further includes a third heat sink tube body 4*b*. The at least one heat sink further includes a third heat sink (not shown).

The first and second ends 21, 22 of the first evaporator tube body 2 communicate with the first chamber 11 of the first evaporator 1. The first and second ends 21*a*, 22*a* of the second evaporator tube body 2*a* communicate with the first chamber (not shown) of the second evaporator 1*a*. The third heat sink tube body 4*b* is connected to the third heat sink. The structure and assembling relationship of the third heat sink tube body 4*b* and the third heat sink are identical to the structure and assembling relationship of the heat sink tube body 4 and the heat sink 5 as shown in FIG. 1B.

In this embodiment, the condensation section 23*a* of the second evaporator tube body 2*a* is attached to the first face 32 of the first heat exchanger 3 and the second face 33*b* of the third heat exchanger 3*b*. In addition, in this embodiment, the at least one recess of the first heat exchanger 3 includes a first recess 341 and a second recess 342. The first and second recesses 341, 342 are respectively formed on the first and second faces 32, 33 of the first heat exchanger 3. The condensation section 23 of the first evaporator tube body 2 is inlaid in the second recess 342 and the at least one recess 34*a* of the second heat exchanger 3*a*. The condensation section 23*a* of the second evaporator tube body 2*a* is inlaid in the first recess 341 and the at least one recess 34*b* of the third heat exchanger 3*b*.

Accordingly, the first face 32 of the first heat exchanger 3 and the second face 33*b* of the third heat exchanger 3*b* are correspondingly attached to each other.

According to the above arrangement, the condensation section 23 of the first evaporator tube body 2 heat-exchanges with the first and second heat exchangers 3, 3*a*. Also, the first heat exchangers 3 heat-exchanges with the second heat exchanger 3*a*. The condensation section 23*a* of the second evaporator tube body 2*a* heat-exchanges with the first and third heat exchangers 3, 3*b*. Also, the first heat exchangers 3 heat-exchanges with the third heat exchanger 3*b*. The first and second heat exchangers 3, 3*a* absorb the heat of the condensation section 23 of the first evaporator tube body 2. The first and third heat exchangers 3, 3*b* absorb the heat of the condensation section 23*a* of the second evaporator tube body 2*a*. The second working medium flows through the first, second and third heat sink tube bodies 4, 4*a*, 4*b* to carry away the heat to flow back to the first, second and third heat sinks. Therefore, the heat exchange area is minified and the heat transfer path is shortened to enhance the heat exchange efficiency.

Figure 4A:
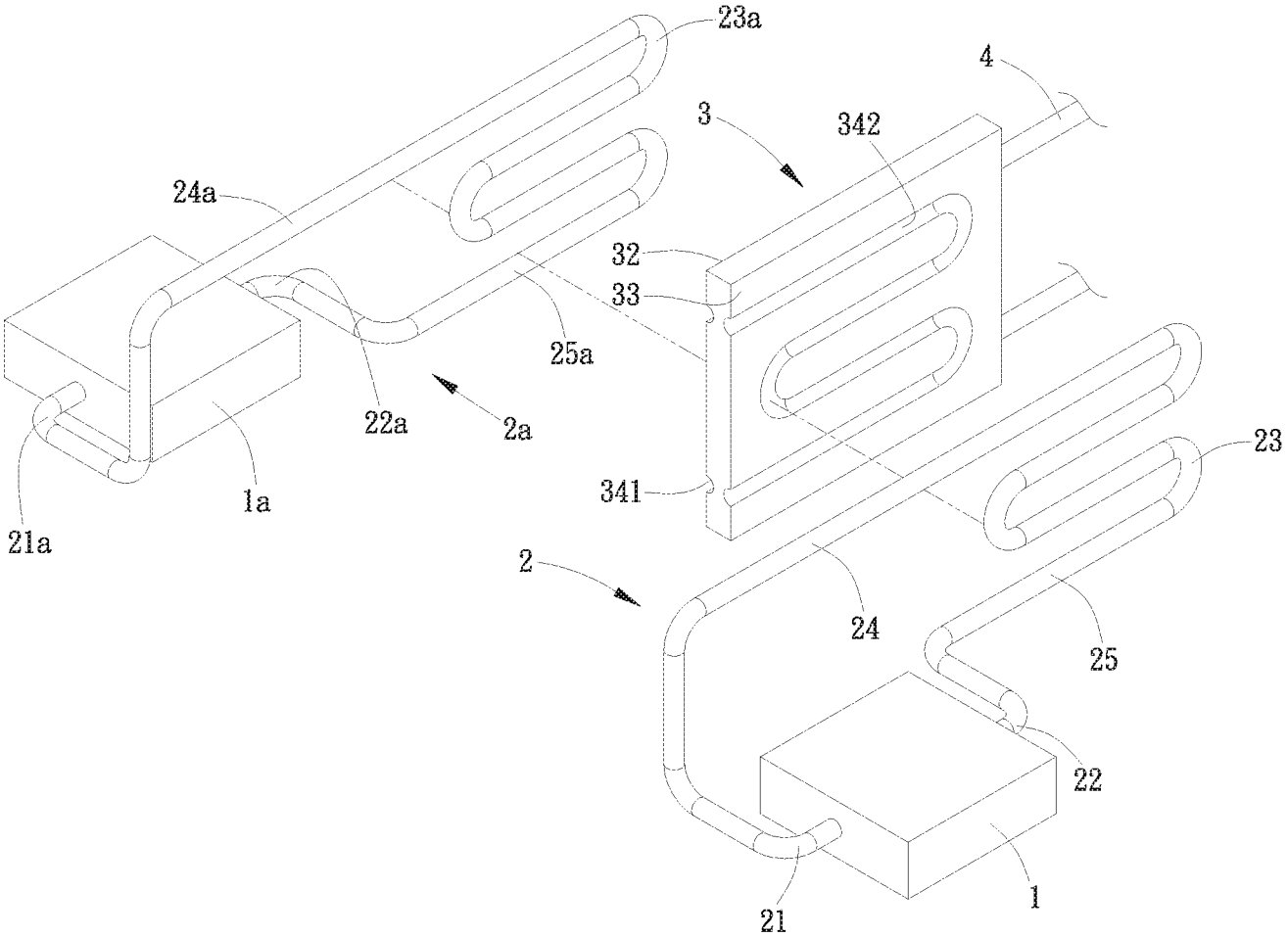
FIG. 4A is a perspective exploded view of a fourth embodiment of the vapor-liquid phase fluid heat transfer module of the present invention.
Figure 4B:
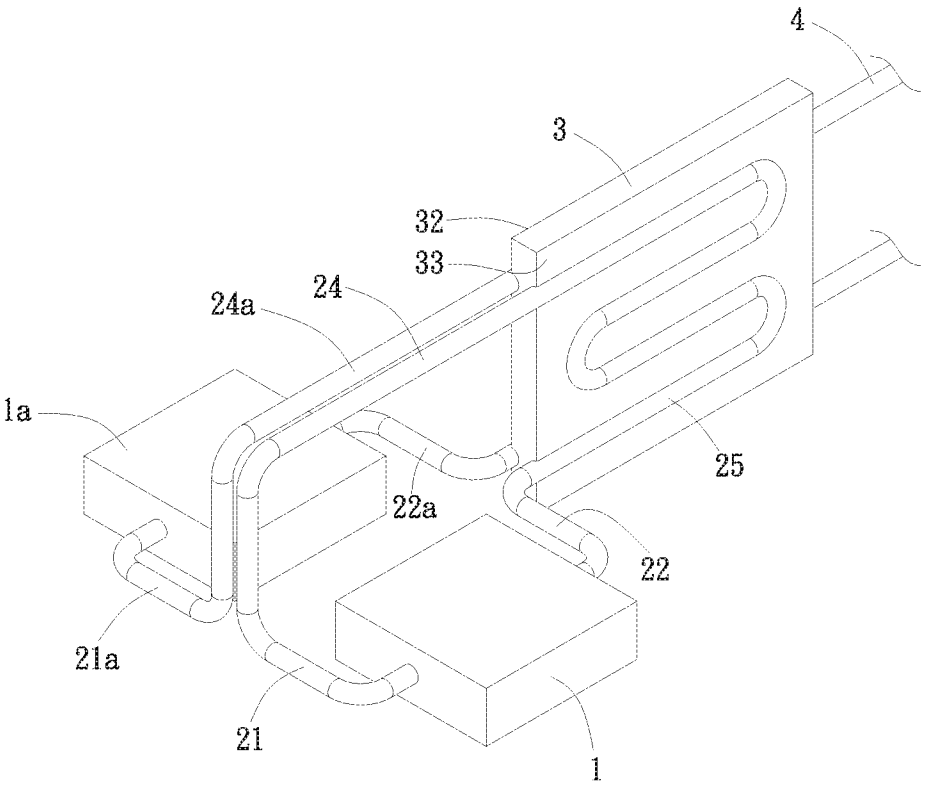
FIG. 4B is a perspective assembled view of the fourth embodiment of the vapor-liquid phase fluid heat transfer module of the present invention.

Please now refer to FIGS. 4A and 4B. FIG. 4A is a perspective exploded view of a fourth embodiment of the vapor-liquid phase fluid heat transfer module of the present invention. FIG. 4B is a perspective assembled view of the fourth embodiment of the vapor-liquid phase fluid heat transfer module of the present invention. Also referring to FIGS. 1A and 1B, the fourth embodiment is partially identical to the first embodiment in structure and function and thus will not be redundantly described hereinafter. The fourth embodiment is different from the first embodiment in that the at least one evaporator includes a first evaporator 1 and a second evaporator 1*a*. The at least one evaporator tube body includes a first evaporator tube body 2 and a second evaporator tube body 2*a*. The first and second ends 21, 22 of the first evaporator tube body 2 communicate with the first chamber 11 of the first evaporator 1. The first and second ends 21*a*, 22*a* of the second evaporator tube body 2*a* communicate with the first chamber (not shown) of the second evaporator 1*a*.

In this embodiment, the first evaporator tube body 2 is, but not limited to, attached to the second face 33 of the heat exchanger 3 and the second evaporator tube body 2*a* is, but not limited to, attached to the first face 32 of the heat exchanger 3. Alternatively, the first evaporator tube body 2 can be attached to the first face 32 of the heat exchanger 3. Still alternatively, the first and second evaporator tube bodies 2, 2*a* are both attached to the first face 32 or the second face 33.

In this embodiment, the at least one recess includes a first recess 341 and a second recess 342. The condensation section 23 of the first evaporator tube body 2 is, but not limited to, inlaid in the second recess 342, while the condensation section 23*a* of the second evaporator tube body 2*a* is, but not limited to, inlaid in the first recess 341. In a modified embodiment, the heat exchanger 3 has a plane surface and the condensation sections 23, 23*a* of the first and second evaporator tube bodies 2, 2*a* are attached to the plane surface of the heat exchanger 3. In another modified embodiment, the condensation sections 23, 23*a* of the first and second evaporator tube bodies 2, 2*a* are inlaid in the first and second recesses 341, 342 of the heat exchanger 3 in flush with the outer surface of the heat exchanger 3.

According to the above arrangement, both the first and second evaporator tube bodies 2, 2*a* heat-exchange with the heat sink 3. The heat exchanger 3 absorbs the heat of the condensation sections 23, 23*a*. The second working medium flows through the heat sink tube body 4 to carry away the heat and flow back to the first and second heat sinks. Therefore, the heat exchange area is minified and the heat transfer path is shortened to enhance the heat exchange efficiency.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A vapor-liquid phase fluid heat transfer module comprising:

at least one evaporator having a first chamber inside, a first working medium contained in the first chamber;

at least one evaporator tube body having a first end, a second end, and a condensation section positioned between the first and second ends, the first and second ends in fluid communication with the first chamber of the at least one evaporator to form a loop of the first working medium;

at least one heat exchanger having a heat exchange chamber inside, a first face, and a second face with the condensation section of the evaporator tube body directly attached to the first or to the second face;

a heat sink;

at least one heat sink tube body in fluid communication with the heat exchange chamber of the at least one heat exchanger and with the heat sink, and a second working medium, the heat sink tube body serving as a loop for the second working medium to flow through.

2. The vapor-liquid phase fluid heat transfer module as claimed in claim 1, wherein the at least one evaporator tube body further has a vapor section in adjacency to the first end and a liquid section in adjacency to the second end, the condensation section being connected between the vapor section and the liquid section.

3. The vapor-liquid phase fluid heat transfer module of claim 2, further comprising a capillary structure disposed in the liquid section.

4. The vapor-liquid phase fluid heat transfer module as claimed in claim 1, wherein the at least one heat exchanger has at least one recess corresponding to the at least one evaporator tube body, the condensation section of the at least one evaporator tube body being inlaid in the at least one recess.

5. The vapor-liquid phase fluid heat transfer module as claimed in claim 4, wherein the at least one heat exchanger includes a first heat exchanger and a second heat exchanger, the at least one heat sink tube body including a first heat sink tube body and a second heat sink tube body, the at least one heat sink including a first heat sink and a second heat sink, the first heat sink tube body communicating with the first heat sink, the second heat sink tube body communicating with the second heat sink, the condensation section of the at least one evaporator tube body being inlaid in the recess of the first heat exchanger and the recess of the second heat exchanger.

6. The vapor-liquid phase fluid heat transfer module as claimed in claim 5, wherein the second face of the first heat exchanger and the first face of the second heat exchanger are correspondingly attached to each other.

7. The vapor-liquid phase fluid heat transfer module as claimed in claim 6, wherein the at least one evaporator includes a first evaporator and a second evaporator, the at least one evaporator tube body including a first evaporator tube body and a second evaporator tube body, the first and second ends of the first evaporator tube body communicating with the first chamber of the first evaporator, the first and second ends of the second evaporator tube body communicating with the first chamber of the second evaporator, the at least one heat exchanger further including a third heat exchanger, the at least one heat sink tube body further including a third heat sink tube body, the at least one heat sink further including a third heat sink, the third heat sink tube body communicating with the third heat sink and the third heat exchanger.

8. The vapor-liquid phase fluid heat transfer module as claimed in claim 7, wherein the at least one recess of the first heat exchanger includes a first recess and a second recess, the first and second recesses being respectively disposed on the first and second faces of the first heat exchanger, the condensation section of the first evaporator tube body being inlaid in the second recess and the at least one recess of the second heat exchanger, the condensation section of the second evaporator tube body being inlaid in the first recess and the at least one recess of the third heat exchanger.

9. The vapor-liquid phase fluid heat transfer module as claimed in claim 8, wherein the first face of the first heat exchanger and the second face of the third heat exchanger are correspondingly attached to each other.

10. The vapor-liquid phase fluid heat transfer module as claimed in claim 4, wherein the at least one heat sink is a water-cooling radiator having a second chamber and a pump, the at least one heat sink tube body having a third end and a fourth end, the third and fourth ends communicating with the second chamber, the pump and the heat exchange chamber to form the loop of the second working medium.

11. The vapor-liquid phase fluid heat transfer module as claimed in claim 10, wherein the at least one evaporator includes a first evaporator and a second evaporator, the at least one evaporator tube body including a first evaporator tube body and a second evaporator tube body, the first and second ends of the first evaporator tube body communicating with the first chamber of the first evaporator, the first and second ends of the second evaporator tube body communicating with the first chamber of the second evaporator.

12. The vapor-liquid phase fluid heat transfer module as claimed in claim 11, wherein the at least one recess includes a first recess and a second recess, the condensation section of the first evaporator tube body being inlaid in the second recess, the condensation section of the second evaporator tube body being inlaid in the first recess.

13. The vapor-liquid phase fluid heat transfer module as claimed in claim 1, wherein the at least one heat exchanger is a water-cooling head.

* * * * *